US006341403B1

(12) United States Patent
Strickrodt et al.

(10) Patent No.: US 6,341,403 B1
(45) Date of Patent: Jan. 29, 2002

(54) TWO-WAY GUARD FOR VACUUM CLEANER

(76) Inventors: Harry K. Strickrodt; Gail A. Strickrodt, both of 1133 Columbus Dr., Stafford, VA (US) 22554; Julie A. Atchison, 2109 Bucknell Ter., Silver Spring, MD (US) 20902

( * ) Notice: Subject to any disclaimer, the term of this patent is extended or adjusted under 35 U.S.C. 154(b) by 0 days.

(21) Appl. No.: 09/608,965

(22) Filed: Jun. 30, 2000

(51) Int. Cl.[7] ..... A47L 9/00
(52) U.S. Cl. ..... 15/325; 15/339; 209/215
(58) Field of Search ..... 15/325, 339; 209/215

(56) References Cited

U.S. PATENT DOCUMENTS

| | | | | |
|---|---|---|---|---|
| 2,241,862 | A | | 5/1941 | Langille |
| 2,847,084 | A | | 8/1958 | Wolfskill et al. |
| 4,279,745 | A | | 7/1981 | Haase |
| 4,300,260 | A | | 11/1981 | Hill |
| 4,355,436 | A | | 10/1982 | Hertzberg |
| 4,598,439 | A | | 7/1986 | Good |
| 4,759,095 | A | | 7/1988 | Hoy, Jr. |
| 4,797,968 | A | | 1/1989 | Wenzlick et al. |
| 4,831,682 | A | | 5/1989 | White |
| 4,876,762 | A | | 10/1989 | Foster |
| 4,947,506 | A | | 8/1990 | Foster |
| D318,938 | S | | 8/1991 | Foster |
| 5,136,747 | A | * | 8/1992 | McCaughan et al. ..... 15/325 X |
| 5,179,756 | A | | 1/1993 | Korsen |
| 5,271,119 | A | | 12/1993 | Myers et al. |
| 5,285,904 | A | | 2/1994 | Haase |
| 5,819,368 | A | | 10/1998 | Wang et al. |

FOREIGN PATENT DOCUMENTS

| | | |
|---|---|---|
| GB | 1065915 | 4/1967 |
| GB | 2154128 A | 11/1985 |

* cited by examiner

*Primary Examiner*—Chris K. Moore
(74) *Attorney, Agent, or Firm*—Varndell & Varndell, PLLC

(57) ABSTRACT

The invention provides a two-way protecting guard for a vacuum cleaner bumper that picks up magnetic metal objects in rugs or carpets prior to such objects entering the vacuum cleaner housing and that prevents damage to furniture and other objects from contact with the vacuum cleaner. The guard of the present invention covers the front and sides of the vacuum cleaner housing, while leaving the top of the housing open or easily accessible. The guard is made of a durable outer covering and contains, disposed within the outer covering, a magnet and padding. The bumper can be secured to the vacuum cleaner by a strap that can be removably fastened to the bumper, or alternatively the bumper can be directly affixed to the vacuum cleaner housing with an adhesive.

16 Claims, 2 Drawing Sheets

10
11
12
13
14
15
16
17
18
20
21
22
23
25
26
3
4

TWO-WAY GUARD FOR VACUUM CLEANER

BACKGROUND OF THE INVENTION

The invention relates to magnetic pick up devices and protective bumpers for portable appliances, such as vacuum cleaners. More particularly, the invention relates to a magnetic vacuum cleaner attachment for picking up metallic objects in rugs or carpets prior to entering the vacuum cleaner housing. The invention also relates to a protective bumper or guard to protect furniture and other objects from damage resulting from contact with the vacuum cleaner.

DISCUSSION OF THE PRIOR ART

U.S. Pat. No. 4,279,745, issued to Haase on Jul. 21, 1981, proposes a vacuum cleaner attachment comprising flexible housing having a series of pockets, each pocket containing a magnet where the housing that is attached to the front wall of the vacuum either by adhesive tape or screws. U.S. Pat. No. 4,300,260, issued to Hill on Nov. 17, 1981, proposes an elongated strip of flexible magnetizable material that is attached to the front face of a vacuum cleaner by either screws, adhesive tape or Velcro® and is positioned lower than the front face of the vacuum. U.S. Pat. No. 4,598,439, issued to Good on Jul. 8, 1986, proposes a magnetic attachment that is placed within the vacuum housing. U.S. Pat. No. 4,759,095, issued to Hoy, Jr. on Jul. 26, 1988, proposes a housing with magnetic strips mounted therein where the entire housing is mounted on the front of a vacuum. U.S. Pat. No. 5,179,756, issued to Korsen on Jan. 19, 1993, proposes a coated magnetic bar attached to a vacuum cleaner housing with hook and loop fastener material commonly marketed under the trademark Velcro®. U.S. Pat. Nos. 4,876,762, 4,947,506 and Des. 318,938 of Foster propose a portable appliance cover including a bonnet that covers the top surface and side surface of a body section of the portable appliance and which includes an energy absorbing means. A major deficiency in the device proposed by Foster is that the bonnet covers the top of the appliance. Covering the top of the appliance makes access to the interior of the portable appliance difficult or impossible without removal of the cover.

SUMMARY OF THE INVENTION

The present invention is related to the field of portable appliances useful for picking up debris and other waste through an opening by action of partial vacuum, such as a vacuum cleaner. More specifically, the invention is concerned with an attachment for a vacuum cleaner that includes a protective guard that wraps around the front and sides of the head of a vacuum cleaner, but not necessarily the top of the head of the vacuum cleaner. Any material covering the top of the vacuum cleaner, such as a strap, is preferably secured to the attachment of the present invention and arranged on the vacuum cleaner in a manner that can be easily removed from the top of the head of the vacuum cleaner. The protective guard of the present invention additionally comprises a magnet. The present invention provides a dual mode or two way protection, which has advantages over prior art vacuum cleaner attachments. Firstly, the guard protects the vacuum cleaner and furniture, fixtures or other items from damage due to contact with the vacuum cleaner. Secondly, the magnet of the guard prevents pins, paper clips and other metal objects from entering the vacuum cleaner housing, thereby preventing damage to the interior parts of the vacuum cleaner, such as the motor. The present invention can comprise a guard having an outer covering, padding and a magnet disposed within the outer covering and means to secure the guard to a vacuum cleaner.

DESCRIPTION OF THE PREFERRED EMBODIMENT

Figures 1, 2, 3, 4:
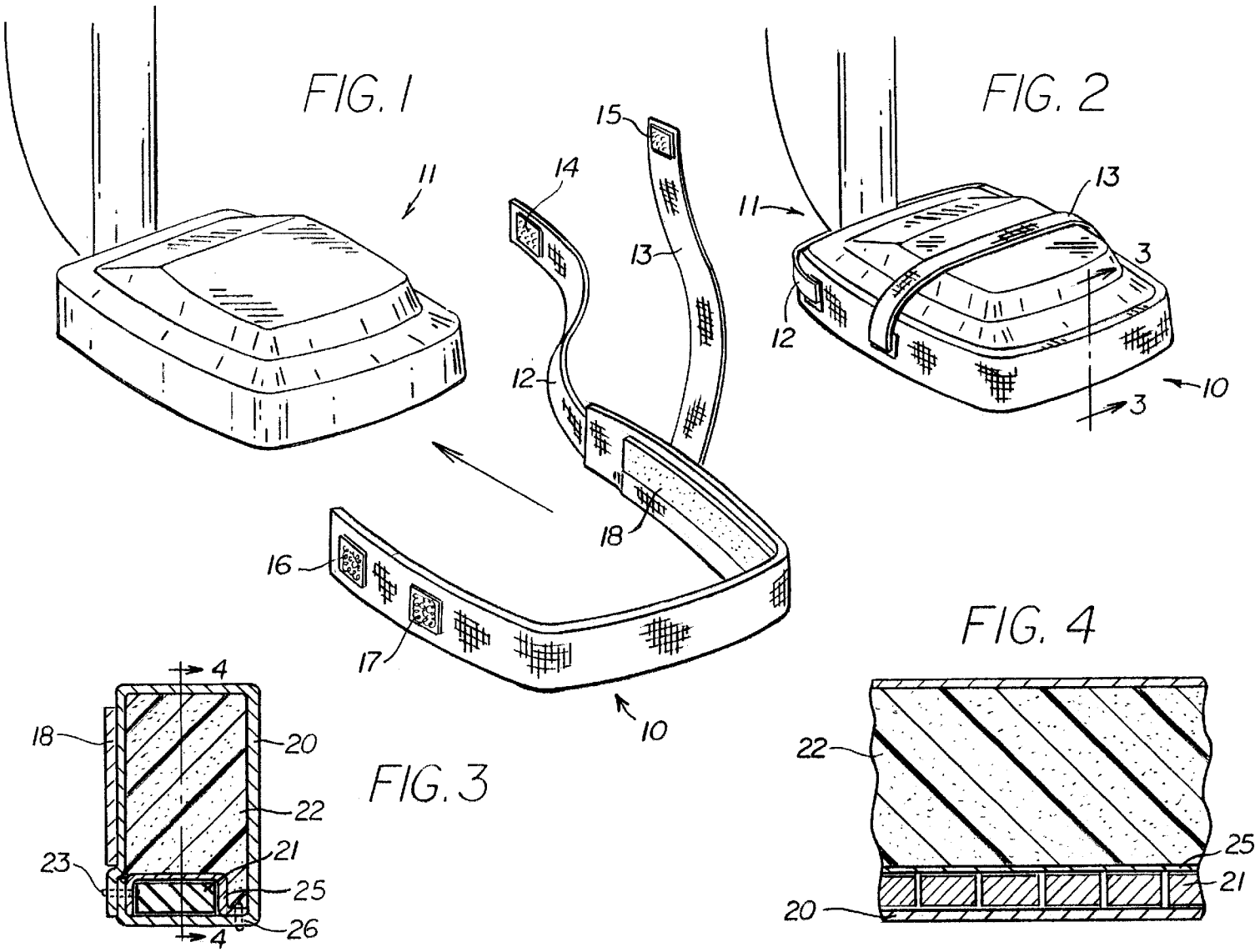
FIG. 1 is a perspective view of the two-way guard in accordance with the present invention shown in relation to a vacuum cleaner.
FIG. 2 is a perspective view showing the two-way guard in accordance with the present invention shown attached to a vacuum cleaner.
FIG. 3 is a cross-sectional view of the two-way guard in accordance with the present invention taken along line 3—3 of FIG. 2.
FIG. 4 is a cross-sectional view of a portion of the two-way guard of the present invention taken along line 4—4 of FIG. 3.

The invention provides a two-way guard that can be attached to a portable appliance such as a vacuum cleaner. The guard of the present invention can wrap around the front and sides of the head of the vacuum cleaner housing while leaving the top of the vacuum cleaner housing open. The guard can be made of a durable outer covering and contains, disposed within the outer covering, a magnet and padding. The guard can be secured to the vacuum cleaner by one or more straps. Releasable fasteners can be used to secure the straps, so that the guard or the strap(s) can be easily removed from the vacuum cleaner. Alternatively, or in addition to the strap(s), the guard can be directly affixed to the vacuum cleaner housing with an adhesive.

In as much as the foregoing has outlined rather broadly the more pertinent and important features of the present invention, the detailed description of the invention that follows provides a more complete description of the invention that will be better understood so that the present contribution to the art can be more fully appreciated. It should be appreciated by those skilled in the art that the conception and the disclosed specific structures may be readily utilized as a basis for modifying or designing other structures for carrying out the same purposes of the present invention. It should also be realized by those skilled in the art that such equivalent methods and structures do not depart from the spirit and scope of the invention.

A significant object of the invention is to provide a two-way guard for a portable appliance having an opening for picking up debris and waste by partial vacuum, such as a vacuum cleaner, that protects the portable appliance. The guard of the invention contains a magnet for capturing magnetic metal objects in rugs or carpets such as pins, needles, staples, paper clips or other metal objects before their entry into the opening of the vacuum cleaner, thereby preventing damage to the vacuum cleaner housing and motor parts by action of the metal objects. The magnetic material or magnet can be provided on the front and/or sides of the head of the vacuum cleaner, thereby attracting and holding metal objects that can be found on the sides of the vacuum cleaner in addition to those in front of the vacuum cleaner.

Additionally, the guard of the invention is designed to completely eliminate or provide only a very small amount of material covering the top of the main housing of the vacuum cleaner or other portable appliance. Eliminating or reducing the amount of material covering the top of the vacuum cleaner housing significantly reduces overheating of the vacuum cleaner during use, when compared to covers that completely surround the vacuum cleaner housing. A guard or cover eliminating any material covering the top of the vacuum cleaner housing, as in the present invention, has the advantage that the top of the vacuum cleaner housing can be opened to access the working parts of the vacuum cleaner including the motor, without removing the guard from the vacuum cleaner. The guard of the present invention can use a minimum amount of material to cover the top of the vacuum cleaner or other the portable appliance, if desired. For example, a strap can be used that spans the top of the vacuum cleaner housing to hold the guard in place on the vacuum cleaner. If such a strap is used, it can be provided in such a way that it can be removed from the top of the vacuum cleaner without removing the guard of the invention. For example, the strap can be held in place by releasable fasteners. With this arrangement the top of the vacuum cleaner housing can be opened to access the working parts of the vacuum by only releasing the strap from the vacuum cleaner, while the guard remains attached to the vacuum cleaner housing.

Another significant object of the invention is to additionally provide a "guard having padding" that will protect both the vacuum cleaner itself as well as furniture, fixtures and other objects that contact the vacuum cleaner when the vacuum cleaner is in use. The padding is provided so that the vacuum cleaner will not mar or scuff furniture, when the furniture is struck by the vacuum cleaner. A still further object of the invention is to provide a guard that does not interfere with the air intake or air circulation around the intake opening of the vacuum cleaner.

FIGS. 1 to 4 illustrate a typical embodiment of the present invention. As shown in FIGS. 1 and 2, the present invention can be easily be attached to a vacuum cleaner 11. The guard can be slid over the front of the vacuum cleaner in the direction of the arrow shown in FIG. 1, and then the straps 12 and 13 can be used to secure the guard in place. The two-way guard 10 of the present invention only covers the front and sides of the head of the vacuum cleaner 11, so that the top of the head of the vacuum cleaner is not covered with the guard. Since a minimum amount of material covers the vacuum cleaner housing, the vacuum cleaner has less of a tendency to overheat during use. Also, since the free end of the strap 13 can easily and quickly be disengaged for the guard 10, the top of the vacuum cleaner housing can easily be opened, if necessary, to access the interior of the housing, such as for repairing the motor.

A single strap 12 can be used to secure the guard in place on the vacuum cleaner. The strap 12 can be affixed to one end of the outer cover 20 by stitching, gluing or other means. The free end of the strap 12 can have a fastener 14 that can be removably fastened to a matching fastener 16 on the opposite end of the outer cover 20. Optionally, an additional strap 13 can be provided. The additional strap can have one end secured along a midpoint of one side of the two-way guard by stitching, gluing or other means. The additional strap 13 can be provided with fastener 15 on the free end thereof, and a matching fastener 17 can be provided at a midpoint of the other side of the two-way guard 10. By the use of strap 12 alone or the combination of straps 12 and 13, the twoway guard 10 can be secured on a vacuum cleaner 11, such as shown in FIG. 2. The straps 12, 13 can be made of any suitable material, such as, for example, an elastic material, or the same material as the outer cover 20.

The fasteners 14, 15, 16, 17 can be hook and loop fasteners, such as those sold under the brand name of Velcro®. Other fasteners, such as snaps or buttons, can also be used. The hook and loop fasteners provide a small amount tolerance or play for adjusting the length of the straps 12, 13. Adjustable length straps can be used for the straps 12, 13 to provide more play, so that the straps can be shortened or lengthen to tightly secure the two-way guard on the vacuum cleaner, and to accommodate vacuum cleaners of different sizes. For this purpose a length adjusting means can be provided for the straps. The length adjusting means can be an adjustable clasp, a belt buckle with a corresponding plurality of holes, an adjustable loop with an S-shaped clasp, a series of buttons and corresponding button holes, etc. In addition, a loop or loops can be provided in place of the fasteners 16, 17 on the outer cover, so that the straps 12, 13 can pass respectively through the loops and be tighten by pulling on the ends of the straps 12, 13. In this arrangement, one end of the straps 12, 13 can be provided with one of a pair of matching fasteners 14, 15 (i.e., hooks), and the straps 12, 13 can be provided with the other of a pair of matching fasteners 16, 17 (i.e., loops) along their length. This structure permits the ends of the straps to pass through the loops, the straps to be pulled tight, and then the ends of the straps to be fastened along the length thereof by the mating of the hook and loop fasteners.

In one embodiment of the invention, the guard 10 is secured to the vacuum cleaner 11 by an adhesive 18, screws or other permanent fixing means. By fixing the guard 10 to the vacuum cleaner with permanent fixing means, such as adhesive 18, the guard 10 can be retained in the proper position relative to the vacuum cleaner. In the proper position the magnets 21 are as close to the ground or the surface to be vacuumed as possible and as close as possible to the opening in the working surface to the vacuum cleaner, and the padding 22 is arranged in front of the magnets and on the front and sides of the housing. The permanent attachment of the furniture guard to a vacuum cleaner secures the vacuum guard in place, so that it is maintained in a position to function effectively.

The adhesive 18 can be applied to the vacuum cleaner housing 19 or to an interior face of the guard 10. It is preferably to apply the adhesive to the interior face of the guard 10. This permits the guard to be distributed as a single unit ready for attachment to a vacuum cleaner. The adhesive applied to the interior face of the guard 10 can have a releasable strip on the exposed surface thereof. With this structure the guard can be secured to the vacuum cleaner by removing the releasable strip and pressing the guard against the vacuum cleaner, so that the adhesive bonds the guard and the vacuum cleaner together. The adhesive is preferably a pressure-sensitive adhesive, which can be in the form of a double-sided adhesive tape. In a preferred embodiment, both an adhesive and one or more straps are used to secure the guard 10 to the vacuum cleaner 11.

Once the guard 10 is secured to the vacuum cleaner by the adhesive 18 in accordance with this embodiment, it is preferable that the adhesive bond is not be broken. Once the bond of a pressure sensitive adhesive is broken, the adhesive has little, if any, remaining adhesive properties. Thus, once the guard has been adhered and removed from the vacuum cleaner, the adhesive may no longer provide sufficient adhesive properties for holding the guard 10 on the vacuum 10 cleaner properly. For this reasons, the guard 10 has been designed so that the top of the housing of the vacuum cleaner is not covered or is covered only by a removable strap. Thus, if the guard 10 is attached to a vacuum cleaner that is in need of repair, the top of the vacuum housing can easily be opened for access to the internal parts of the vacuum cleaner without removing the guard and breaking the adhesive bond between the guard 10 to a vacuum cleaner 11.

As shown in FIG. 3, the guard 10 comprises an outer covering 20, a magnet 21 and padding 22. The padding 22 of the guard 10 is preferably high-density closed-cell foam. The higher the density of the foam padding, the thinner the thickness of the padding needed to protect furniture. High-density, closed-cell foam is preferable as the padding from the viewpoints of protecting furniture, weatherability, resistance to mildew and molding, and the fact that it does not absorb water. Padding commonly available at garden supply stores for knee pads can be used. Foams, such as the 2# density Trocellen manufactured by Dynamit Nobel of American, Inc. of South Holland, Ill., in a thickness of 0.125 to 2 inches or more can be used. A preferable total thickness for the padding is about 0.25 to about 1.5 inches. However, other padding materials and combinations of two or more padding materials can be used as long as they provide sufficient padding to prevent damage to furniture when a vacuum cleaner containing the guard of the present invention is struck against the furniture. The padding material 22 is arranged above and in front of the magnet 21, as shown in FIG. 3. The padding material 22 can have a notch or groove in the bottom thereof for receiving the magnet 21, as shown in FIG. 3. Two separate pieces of padding can be used, where one piece of padding is arranged in front of the magnet either extending a portion or the complete height of the guard, and another piece of padding can be arranged above the magnet 21. When two or more pieces of padding are used, the different pieces of padding can have different densities or energy absorbing properties. For example, a soft padding can be used on the external surface that may come in contact with furniture or fixtures and a firm padding can be used adjacent to the vacuum cleaner itself.

The outer covering 20 is made of a durable material that will not scuff or mar furniture or fixtures upon contact. Suitable materials for the outer cover to include non-rip nylon fabric or marine grade canvas. Other materials can also be used for the outer covering 20 including other fabrics or other non-fabric materials. For example, plastic materials, such as polyvinyl and polyester, in sheet or other forms can be used for the outer covering. A heat-shrinking plastic material can be provided in tubular form or a sheet of heat-shrinking material can be wrapped around the magnet and padding. When heat is applied to heat-shrinking plastic material, it collapses around the padding and magnet forming a composite structure.

The functions of the outer covering 20 are to hold the magnet and padding in place, to have long wearability, and not to mar or damage furniture when in contact therewith. Once the magnet 21 and padding 22 are inserted within the outer covering 20, the outer covering 20 is closed and secured by any appropriate means such as glue or stitches 23. As shown in FIG. 3, the outer covering 20 can be a single piece of material that can be formed into a tubular material and stitched to itself, so as to hold the padding 22 and the magnet 21 therein. Alternatively, multiple pieces of covering can be used to provide inner and outer surfaces that are secured together by appropriate means such as glue or stitches.

In this specification the words "magnet" or "magnets" are used to refer to a single magnet or a plurality of magnets interchangeably. A single magnet can be used in the present invention. A single magnet should have a length equal to the length of the opening in working surface of the vacuum cleaner and a shape to match the contour of the front of the vacuum cleaner housing to which it is attached. The plurality of magnets 18 can be of different sizes and strengths depending upon the needs of the user and the size/shape of the metal objects that are contained in the surface to be cleaned. Any magnets of any composition can be used, such as solid iron containing magnets available from Radio Shack®. The magnets are preferably arranged end-to-end along the bottom of the guard 10, as shown in FIGS. 3 and 4. Preferably, the magnet or magnets extend at least across the entire length of the opening in the working surface of the vacuum cleaner, so that any metallic object on the surface to be cleaned will encounter the magnets before the opening. It is desirable that the magnet or magnets have a size that can adapt to the contour of the front of the housing of the vacuum cleaner, so that a close fitting can be provided between the cover and the vacuum cleaner. For example, the magnets can have length of about 0.5 to 2.5 inches, a width of 0.25 to 1 inches, and a depth of 0.25 to 1.5 inches. As shown in FIGS. 3 and 4, a pocket 25 can be provided along the length of the guard by a piece of fabric material or other suitable means for holding the plurality of magnets in place along the bottom of the guard 10 and adjacent the vacuum. machine 11.

The two-way guard of the present invention 10 can be made in different widths and lengths to accommodate different types of vacuum cleaner housings. The guard 10 can be constructed as follows. A piece of material is cut to an appropriate size for the outer covering 20, a pocket 25 is provided in the outer covering with a second piece of material by stitching 26 or other means, the magnets 21 are placed into the pocket, the padding 22 is arranged in front of and above the magnets 21, and the outer cover 20 is arranged to surround the magnets 21 and the padding 22 and secured to itself by stitching 23 or other means to form the main body of the guard 10. Once the main body of the guard 10 is formed, the strap(s) 12, 13 can be secured thereto by stitching, and then the adhesive strip 18 can be applied to the inner surface of the guard 10.

Figure 6:
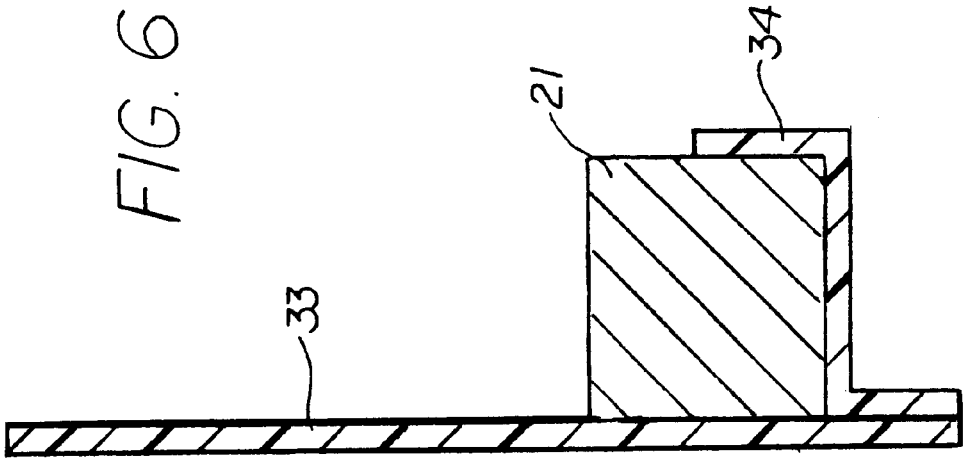
FIG. 6 is an enlarged cross-sectional view of a portion of the backing strip of the present invention taken along line 6—6 of FIG. 5.
Figure 5:
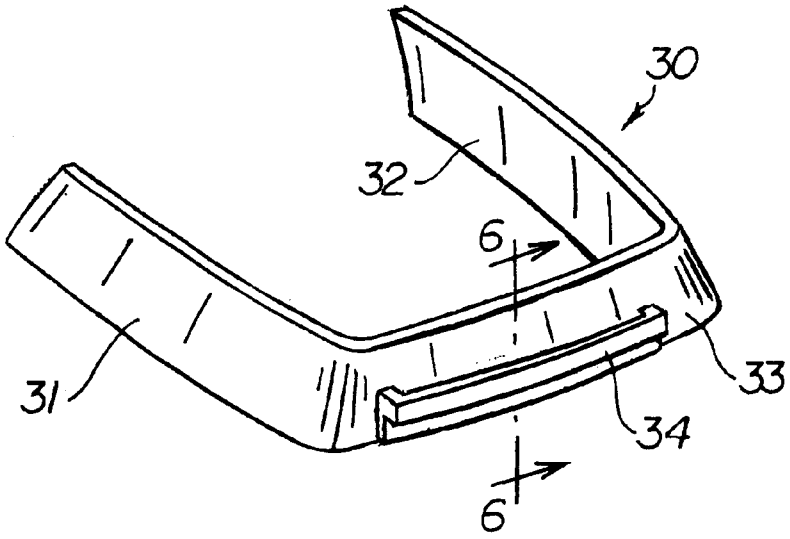
FIG. 5 Illustrates a backing strip that can be used in the presently claimed invention.

A flexible backing can be used in the presently claimed invention, as shown in FIGS. 5 and 6. The flexible backing can be made of a thin, flexible strip having some rigidity. Typical materials that can be used for the flexible backing include plastics such as polycarbonate, polystyrene, polymethacrylate, polyacrylate, or any other material that can provide some stiffness or rigidity to the two-way guard. For example, materials that are commonly for paint guards and are available in hardware stores can be used for the flexible backing.

The flexible backing provides a number of advantages to the present invention. The flexible backing makes the two-way guard more rigid. A more rigid two-way guard is easier for the user to handle, and it stays in place better on the vacuum cleaner during use. Further, the flexible backing facilitates construction of the two-way guard.

As shown in FIG. 5, the flexible backing 30 can a plastic strip can include two side panels 31, 32, that are both joined to a front panel 33. The front and side panels can be made from one strip of material or can be separate materials joined together by any suitable means, such as adhesive, stitching, or stapling. A pocket 34 can be provided on the front of the flexible backing. The pocket is constructed to hold the magnets 21. The pocket 34 can be made of the same flexible, thin plastic material as the backing strip or of other material.

The pocket 34 can be molded into the backing strip, so that a single integral molded backing piece is provided having the pocket 34 therein. Alternatively, a piece of material can be secured to the front 33 of the backing strip 30 by adhesive, stitching, or other appropriate means. As show in FIG. 6, a magnet 21 or a plurality of magnets 21 can be provided in the pocket.

When making the device of the present invention, the magnets 21 can be placed into the pocket 34 of the flexible backing 30 or, if the flexible backing strip does not contain a pocket, they can be secured on the flexible backing strip by adhesive or other means. After the magnets are in place, the foam or padding 22 can be placed over the front 33 of the backing strip 30 and in front of the magnets 21. If desired, a slot or cutout can be provided in the foam or padding 22 to accommodate the magnets 21, as shown in FIG. 3. The foam can be secured to the backing strip by an adhesive, if desired, but it is not necessary. Thereafter, the backing strip, magnets, and foam are enveloped in an outer covering 20 that is stitched or otherwise secured together to form a unitary structure. Thereafter, the fastening strips 12 and 13 can be secured to the unitary structure to provide the two-way guard of the present invention.

Normally, a vacuum cleaner has a housing that slopes downward and outward in the front and sides. The two-way guard of the present invention can be made to accommodate this structure. When the two-way guard has a structure closely matching the housing of the vacuum cleaner, it stays in place better on the vacuum cleaner during use. The flexible backing 33 can provide a skeleton or basic structure for the two-way guard that matches the shape of the vacuum cleaner housing. The front panel 33 and side panels 31, 32 can be constructed so that the top opening of the two-way guard of the present invention is smaller than the bottom opening or, in other words, the top of the two-way guard has a smaller circumference or shorter length than the bottom of the two-way guard. The smaller opening at the top of the two-way guard assists in holding the two-way guard on the vacuum cleaner housing, which may be similar to the manner in which a visor is held on a person's head. One way to achieve such a structure that closely fits or grasps the vacuum cleaner housing is for at least one of the front panel 33 and side panels 31, 32 to have a quadrilateral shape, such as a trapezoidal shape. The front panel 33 can have quadrilateral shape and, more preferably, both the front panel 33 and side panels 31, 32 can have a quadrilateral shape. A preferred quadrilateral shape is one where the bottom edge of a respective panel is longer than the top edge, so that the side edges form an acute angle with the bottom edge, and side edges from an obtuse angle with the top edge. The top and bottom edges can be parallel so as to form a trapezoidal shape. Front and side panes having such a quadrilateral shape can be joined together at their respective side edges to form a unitary structure, as shown in FIG. 5. Adhesives, stitching, stapling or other means can be used to join the panels together. Alternatively, the backing strip can be molded so that the three panels have the quadrilateral structure or other desired structure. Shapes other than quadrilateral shapes can be used for the front and side panels 31, 32, and 33. It is preferred that such shapes have a top edge that is shorter that a bottom edge, so that the a flexible backing 30 can be provided with a top opening that is smaller than the bottom opening.

It is important that the two-way guard 10 be constructed so that the magnets 21 are arranged at the bottom of the guard. The individual magnets have a height or a width with a longer dimension, and the magnet can be arranged in the guard so that the longer dimension is parallel or perpendicular to the working surface of the vacuum cleaner 11. For example, the magnets can be arranged so that more of the magnet faces the rugs or carpets being vacuumed and the magnetic attraction force for metallic objects contained in the rugs or carpets is increased, as shown in FIG. 3. Alternatively, the magnets can be arranged so that they fit tightly against the vacuum cleaner housing, so to protrude from the housing as little as possible. In addition, the two-way guard can be arranged on the vacuum cleaner so that the magnets 21 are as close to the ground or the surface to be vacuumed as possible. It is also preferred that the magnets 21 are arranged as close as possible to the opening in the working surface to the vacuum cleaner. When the magnets are arranged in this manner, they can best attract and pick up metal objects before they enter the opening in the working surface to the vacuum cleaner.

It will be apparent to those skilled in the art that various modifications and variations can be made in the portable appliance cover of the present invention without departing from the scope or spirit of the invention. Thus, it is intended that the present invention cover the modifications and variations of this invention provided they are within the scope of the appended claims and their equivalents.

What we claim is:

1. A two-way protecting guard for a portable appliance; the portable appliance including a body having a front and sides, a working surface arranged between the front and sides and disposed adjacent a surface to be cleaned when the appliance is in use, and an opening in the working surface for receiving debris and litter drawn into the body section by a partial vacuum; the two-way protecting guard comprising:

padding adapted to cover the front and sides of the body of the portable appliance, a magnet having a length at least as long as a length of the opening in the portable appliance, a single cover encasing the padding and magnet, the cover being a separate material from the padding, and at least one strap for securing the two-way protecting guard to the portable appliance, the padding, magnet and cover forming an integral unit that is arranged so that when the two-way protecting guard is secured to the body of the portable appliance, the padding is arranged on the front and sides of the body of portable appliance and the magnet is arranged on a lower part of the front of the body of the portable appliance between the body of the portable appliance and the padding.

2. The two-way protecting guard of claim 1, wherein the at least one strap includes a strap having a first end affixed to the cover and a second end with a one of a pair of matching fasteners, and the cover contains another of the pair of matching fasteners, so that the strap can be secured to the cover.

3. The two-way protecting guard of claim 2, wherein the pair of matching fasteners is hook and loop fasteners.

4. The two-way protecting guard of claim 2, wherein the strap is made of elastic material.

5. The two-way protecting guard of claim 1, wherein the cover has an adhesive for securing the cover to the front of the body of the portable appliance.

6. The two-way protecting guard of claim 5, wherein the adhesive is a double-sided adhesive tape.

7. The two-way protecting guard of claim 1, wherein the padding comprises a high-density closed-cell foam.

8. The two-way protecting guard of claim 1, wherein the magnet includes a plurality of magnets arranged end-to-end in a bottom of the two-way protecting guard.

9. The two-way protecting guard of claim 8, wherein a pocket is provided in the bottom of the two-way protecting guard and the plurality of magnets is arranged in the pocket.

10. The two-way protecting guard of claim 1, wherein the padding, magnet and cover are formed into a three-dimensional shape having a top opening that is smaller than a bottom opening, the top and bottom openings for fitting over a housing of a vacuum cleaner.

11. A two-way protecting guard for a portable appliance; the portable appliance including a body having a front and sides, a working surface arranged between the front and sides and disposed adjacent a surface to be cleaned when the appliance is in use, and an opening in the working surface for receiving debris and litter drawn into the body section by a partial vacuum; the two-way protecting guard comprising:

padding adapted to cover the front and sides of the body of the portable appliance, and the padding having a groove, a magnet having a length at least as long as a length of the opening in the portable appliance, and the magnet being received in the groove of the padding, a cover encasing the padding and magnet, and at least one strap for securing the two-way protecting guard to the portable appliance, the padding, magnet and cover are arranged so that when the two-way protecting guard is secured to the body of the portable appliance, the padding is arranged on the front and sides of the body of portable appliance and the magnet is arranged on a lower part of the front of the body of the portable appliance between the body of the portable appliance and the padding.

12. A two-way protecting guard for a portable appliance; the portable appliance including a body having a front and sides, a working surface arranged between the front and sides and disposed adjacent a surface to be cleaned when the appliance is in use, and an opening in the working surface for receiving debris and litter drawn into the body section by a partial vacuum; the two-way protecting guard comprising:

padding adapted to cover the front and sides of the body of the portable appliance, a magnet having a length at least as long as a length of the opening in the portable appliance, a flexible backing for supporting the padding and magnet, a cover encasing the padding, magnet and flexible backing, and at least one strap for securing the two-way protecting guard to the portable appliance, the padding, magnet and cover are arranged so that when the two-way protecting guard is secured to the body of the portable appliance, the padding is arranged on the front and sides of the body of portable appliance, the magnet is arranged on a lower part of the front of the body of the portable appliance between the body of the portable appliance and the padding, and the flexible backing is arranged behind the magnet.

13. The two-way protecting guard of claim 12, wherein the flexible backing includes a pocket for holding the magnet.

14. The two-way protecting guard of claim 12, wherein the magnets are secured to the flexible backing by an adhesive.

15. The two-way protecting guard of claim 12, wherein the flexible backing includes a front panel joined to two side panels.

16. The two-way protecting guard of claim 15, wherein at least one of the front and side panels has a shape with a top edge that is shorter than a bottom edge.

* * * * *